US006312345B1

(12) United States Patent
Pelz

(10) Patent No.: US 6,312,345 B1
(45) Date of Patent: Nov. 6, 2001

(54) GOLF PRACTICE PLATFORM FOR A VARIETY OF GOLF SHOTS

(76) Inventor: David T. Pelz, 1310 Ranch Rd. 620, South, Suite B-1, Austin, TX (US) 78734

( * ) Notice: Subject to any disclaimer, the term of this patent is extended or adjusted under 35 U.S.C. 154(b) by 0 days.

(21) Appl. No.: 09/574,971

(22) Filed: May 12, 2000

(51) Int. Cl.[7] ..... A63B 57/01; A63B 69/36; A63B 67/02

(52) U.S. Cl. ..... 473/278; 473/279; 473/150

(58) Field of Search ..... 273/108.2; D21/789, D21/790, 791, 792; 473/150, 157, 158, 159, 160, 162, 163, 164, 166, 167, 171, 173, 174, 218, 261, 262, 266, 278, 279

(56) References Cited

U.S. PATENT DOCUMENTS

| | | | | |
|---|---|---|---|---|
| D. 312,117 | * | 11/1990 | Duncan | D21/792 |
| 3,348,847 | | 10/1967 | Fischl | 273/186 |
| 3,735,988 | * | 5/1973 | Palmer et al. | 273/178 B |
| 3,753,563 | * | 8/1973 | Previte, Jr. | 273/186 C |
| 3,994,501 | | 11/1976 | O'Donnell | 273/183 A |
| 4,279,420 | * | 7/1981 | Bay et al. | 273/187 A |
| 4,387,896 | | 6/1983 | O'Brien | 273/195 A |
| 4,630,828 | | 12/1986 | Lovin | 273/176 FB |
| 4,659,084 | | 4/1987 | Vuick | 273/183 B |
| 4,875,685 | | 10/1989 | Ballinger et al. | 273/195 B |
| 4,895,372 | | 1/1990 | Muller | 273/183 B |
| 4,932,663 | | 6/1990 | Makar | 273/195 A |
| 5,004,243 | | 4/1991 | Dlouhy | 273/195 A |
| 5,033,747 | | 7/1991 | Young | 273/195 R |
| 5,263,719 | | 11/1993 | Bunn | 273/186.1 |
| 5,340,109 | | 8/1994 | Miller | 273/186.1 |
| 5,346,220 | | 9/1994 | Cooper et al. | 273/191 R |
| 5,354,064 | | 10/1994 | Toikka | 273/195 A |
| 5,478,082 | | 12/1995 | De Knight et al. | 273/187 R |
| 5,591,090 | | 1/1997 | Kauffman, Jr. | 473/271 |
| 5,593,355 | * | 1/1997 | Beaver | 473/278 |
| 5,616,085 | | 4/1997 | LaCoste, Jr. et al. | 473/267 |
| 5,634,858 | | 6/1997 | Bellagamba | 473/257 |
| 5,676,604 | | 10/1997 | McCormick | 473/263 |
| 5,720,670 | * | 2/1998 | Okley et al. | 473/279 |
| 5,803,820 | | 9/1998 | McCarty | 473/173 |
| 5,803,826 | | 9/1998 | Perrine | 473/278 |
| 5,916,034 | * | 6/1999 | Lancia | 473/157 |
| 5,947,834 | * | 9/1999 | Hope et al. | 473/224 |
| 6,024,656 | * | 2/2000 | Lane | 473/409 |

* cited by examiner

*Primary Examiner*—Jeanette Chapman
*Assistant Examiner*—Alvin A Hunter, Jr.
(74) *Attorney, Agent, or Firm*—Welsh & Flaxman

(57) ABSTRACT

A golf ball hitting platform for practicing a variety of golf shots having a base upon which a golfer stands and interchangeable teeing panels at the teeing area, including a fairway teeing panel, a rough teeing panel, a bunkerboard teeing panel, a bunker tray teeing panel and a special fairway panel for use with sloped platform settings. The platform also includes training attachments including a knee brace, a shank preventing upright wall, a swing limiter to limit the length of the golfer's backswing and a swing plane guide to insure a proper take-away and define an inside plane of the swing path. Elevating blocks allow the platform to be oriented to simulate a variety of slope conditions.

20 Claims, 8 Drawing Sheets

FIG. 8
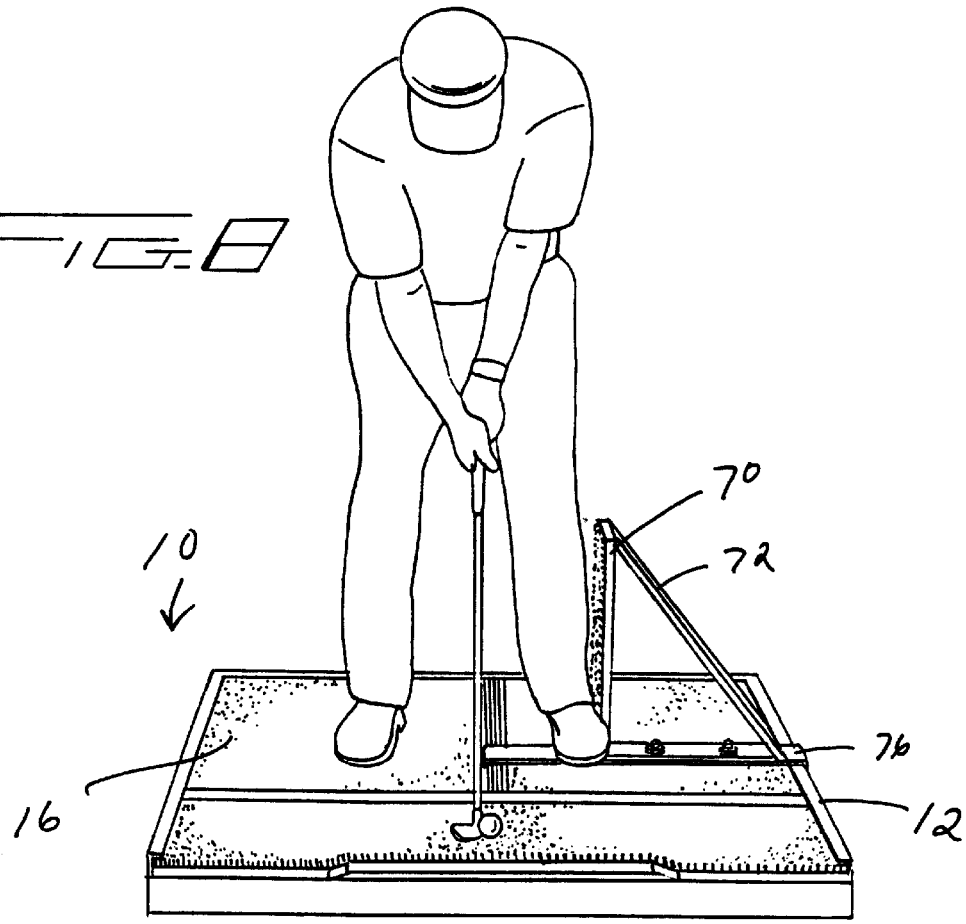
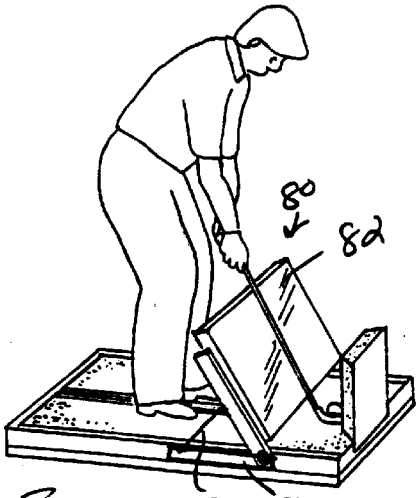
FIG. 10
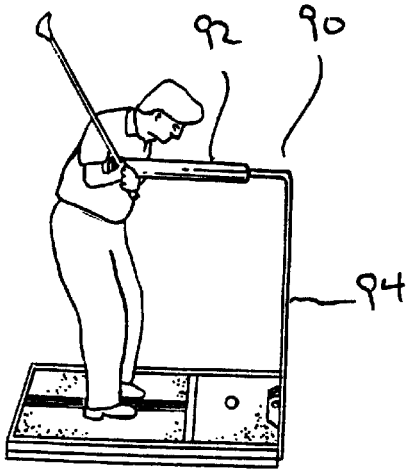
FIG 11

GOLF PRACTICE PLATFORM FOR A VARIETY OF GOLF SHOTS

BACKGROUND OF THE INVENTION

1. Field of the Invention

The present invention relates to a golf practice apparatus. More particular, the invention relates to a golf ball hitting platform having a variety of interchangeable practice and training devices used therewith.

2. Description of the Prior Art

There are a wide variety of prior art golf practice mats designed to enable a golfer to practice his swing and to simulate various playing situations and conditions encountered on a golf course during the playing of a game of golf.

Specific examples of prior art golf ball hitting mats are disclosed in a variety of U.S. patents. For example, U.S. Pat. Nos. 3,348,847 to Fischl and 4,932,663 to Makar disclose golf mats including structure for simulating the taking of a divot during a golf swing. The Makar patent includes a rigid frame and an artificial turf structure attached to the frame. The turf structure is held under tension in such a way that the turf moves downward upon impact with a golf club to simulate conditions found on a natural golf course.

U.S. Pat. Nos. 4,630,828 to Lovin and 5,803,820 to McCarty are both directed to portable sand trap devices including a receptacle which is filled with sand to enable the golfer to practice sand shots.

U.S. Pat. No. 5,004,243 to Dlouhy shows a golf practice mat including a base having a cavity to position and support a removable tee pad formed of a polyfoam material. The tee pad is capable of removably receiving and supporting a conventional golf tee at any selected depth. The patent further teaches that an artificial turf sheet may also be used to allow fairway type shots to be practiced.

U.S. Pat. No. 4,875,685 to Ballinger et al. shows a golf practice apparatus including a main frame platform and a fairway turf component. The apparatus includes a removable continuous belt having a turf simulating surface.

U.S. Pat. Nos. 5,033,747 to Young, 5,354,064 to Toikka and 5,803,826 to Perrine disclose golf swing practice mats having a variety of different simulated ball striking surfaces.

U.S. Pat. No. 4,387,896 to O'Brien shows a golf practice mat having a slidable synthetic grass hitting surface within a rectangular frame to provide a more natural feel to the golfer. The mat simulates the action that natural turf assumes as a divot is taking when the club head strikes the grass surface.

U.S. Pat. Nos. 5,263,719 to Bunn, 5,346,220 to Cooper et al., 5,478,082 to De Knight et al. and 5,676,604 to McCormick disclose a variety of guides for preventing an improper swing path as a golfer strikes a golf ball. Each guide includes a barrier which extends above the support surface for guiding the golf club, whereby the golf club will contact the barrier if an improper swing path is made.

U.S. Pat. Nos. 4,659,084 to Vuick, 4,895,372 to Muller, 5,591,090 to Kauffman, Jr., 5,616,085 to LaCoste, Jr. et al. and 5,634,858 to Bellagamba all disclose a variety of barrier devices to be positioned adjacent a golfer's forward knee to form a barrier against improper or unwanted movement during the execution of a golf swing.

While a variety of golf training devices are disclosed above, a need continues to exist for improved training devices. The present invention provides such an improved training device.

SUMMARY OF THE INVENTION

The present invention relates to a golf ball hitting platform including a base frame upon which the golfer stands and interchangeable teeing panels located at an adjacent teeing area. The interchangeable teeing panels include a fairway teeing panel, a rough teeing panel, a bunkerboard panel, a bunker panel and a special fairway panel for use with sloped platform settings. In addition, the platform may include elevating blocks allowing the platform to be positioned in various orientations simulating, for example, a downhill lie, an uphill lie, a side hill lie with the ball above the golfer's feet or a side hill lie with the ball below the golfer's feet.

Training attachments are also provided to give a golfer feedback in response to a number of common swing faults. One training attachment available in accordance with the present invention is an upright wall positioned adjacent the teeing area which prevents a golfer from extending the club head beyond the golf ball during the execution of a swing to prevent a shanked shot.

Another training attachment is a knee brace positioned on the platform. The knee brace prevents the golfer's knee from laterally sliding toward the target, a common swing error.

Still another training attachment is a swing limiter which attaches to the hitting area of the platform to limit the length of a golfer's backswing by providing feedback to the golfer. The swing limiter is adjustable along the backswing path.

A further training attachment is a swing plane guide which forces a proper take-away and defines the inside plane of a golfer's swing through the impact area where the golf ball is struck.

It will be appreciated that the various teeing panels and training attachments may be used interchangeably to simulate a number of golf shots found on a golf course during the playing of a game of golf. Initially, a golfer may use the training device of the present invention oriented in a flat planar configuration with a teeing panel having a simulated grass, mat surface and/or a conventional tee for use with golf clubs used to hit golf shots when the ball is teed up. A golfer may use the elevating blocks in combination with a simulated grass panel teeing attachment to produce an uneven lie with the ball above his feet, below his feet, on a downhill slope, and on an uphill slope.

Another use of the training device of the present invention allows a golfer to prevent the shanking of a golf shot by the addition of an upright wall adjacent the end of the teeing surface. This enables golfers who often shank to acquire the feel of a correct golf swing where the golf club head does not extend outwardly past the ball. This results in the ball being hit on the center of the club face rather than on the shank or hosel of the club head.

Still another use of the training device of the present invention, allows a golfer to practice his swing against a knee brace. The knee brace prevents a golfer from sliding his knee toward the target, a common swing error. The training device of the present invention also includes interchangeable teeing panels for practicing sand or bunker shots. Another attachment is a bunker board, having a slightly concave upper surface filled with sand to enable a golfer to practice sand shots. A similar attachment is a bunker tray which may be filled with sand to also allow a golfer to practice sand or bunker shots.

It will be appreciated that a wide variety of teeing panel attachments may be provided for simulating various turf and rough conditions normally found on the golf course during the playing of a game of golf.

Among the objects of the present invention is the provision of a golf practice platform which simulates a wide variety of conditions found on a golf course during the playing of a game of golf.

Another object of the present invention is to provide a golf practice platform having a plurality of training attachments which train a golfer to swing a golf club along a predetermined swing path for optimum ball contact and energy transfer.

Still another object of the present invention is the provision of a golf teeing platform having a plurality of interchangeable attachments to simulate various conditions found on a golf course.

Other objects and advantages of the present invention will become apparent from the following detailed description and drawings, which set forth certain embodiments of the invention.

BRIEF DESCRIPTION OF THE DRAWINGS

FIG. 3 is a perspective view of the golf practice platform of FIG. 1 and attachments and accessories therefor.

FIG. 8 is a perspective view of the golf platform of FIG. 1 with a second attachment member.

FIG. 10 is a perspective view of the golf platform of FIG. 1 with a third attachment member.

FIG. 11 is a perspective view of the golf platform of FIG. 1 with a forth attachment member.

DESCRIPTION OF THE PREFERRED EMBODIMENTS

Figures 1, 2:
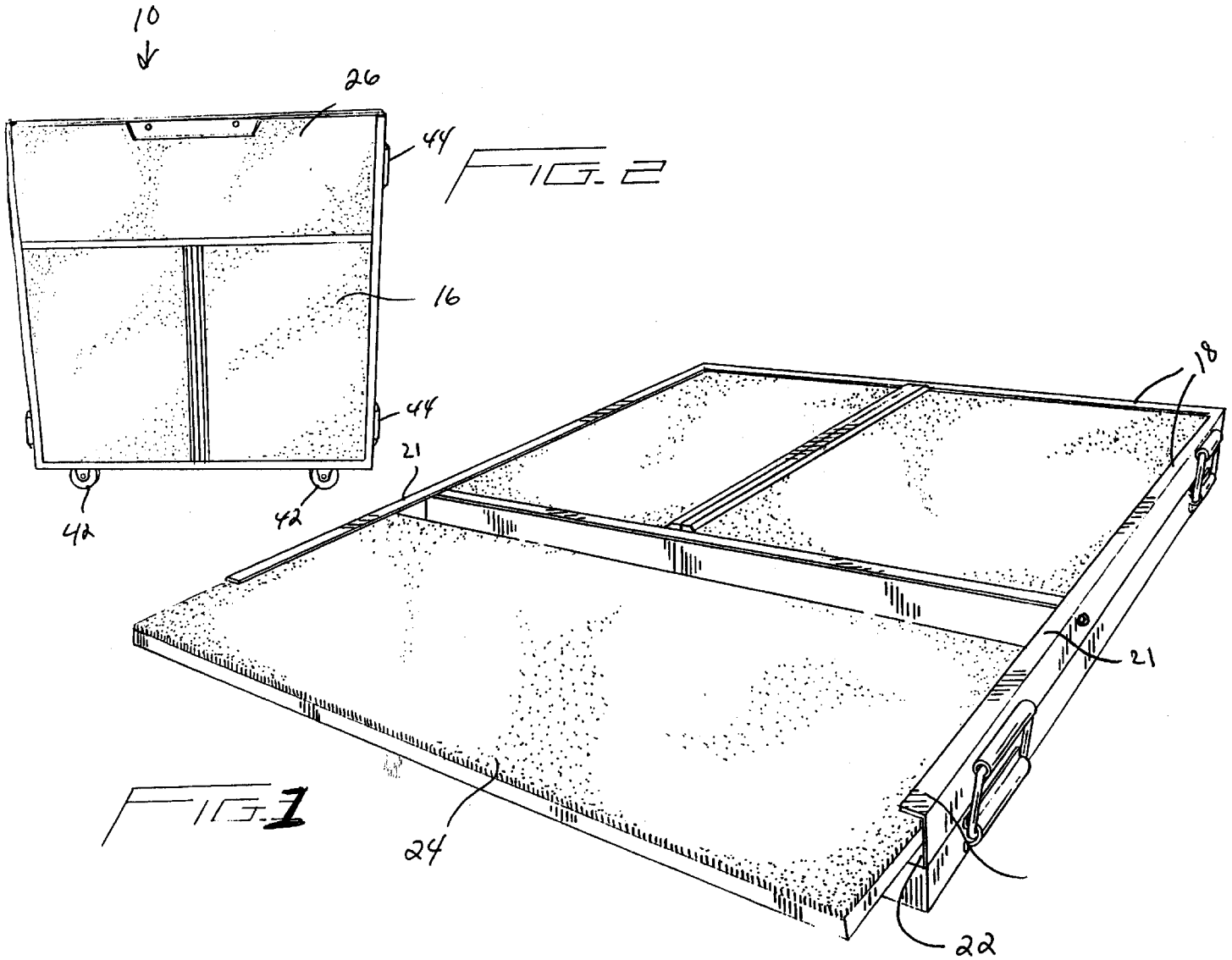
FIG. 1 is a perspective view of the practice platform in accordance with the present invention with a first teeing panel partially inserted in place.
FIG. 2 is an elevational view of the practice platform of FIG. 1 with a teeing area accessory panel in place.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Referring to the drawings, the golf training apparatus takes the general form of a golf ball hitting platform 10. The platform 10 includes a main support frame 12 having an upper planar support surface 14. The upper planar support surface 14 is preferably formed of a simulated grass mat 16 which is generally rectangular in shape, approximately 2'×3' in size and formed in one or two sections. The mat 16 is supported by overlapping flanges 18 of the main support frame 12 and is replaceable with another mat if it becomes worn. The underside (not shown) of the platform 10 is recessed inwardly for purposes described hereinbelow.

One lateral edge of the main support frame 12 is formed with a lowered, or recessed, planar surface 20 and a slotted channel 22 formed by the main support frame 12 and upper flanges 21 in order to receive a selected one of a plurality of teeing area panels 24. The teeing area panels 24 are interchangeably connected to the main support frame 12 by slidably fitting into the channel 22 such that the teeing panel 24 rests on the planar support surface 20. Preferably, the channel 22 is sized to provide a loose friction fit with the teeing area panel 24. Teeing area panel 24 is a planar simulated grass support surface, which is used as a teeing area for hitting golf balls.

FIG. 3 shows a plurality of interchangeable teeing area panels 26, 28 and 30 which may be used in accordance with the present invention. Teeing area panel 26 is a simulated grass, planar support surface having a slot 46 along an outer longitudinal edge 32 to accommodate another accessory as described hereinbelow. Teeing area panel 28 is a simulated grass, planar support surface having a bunker board accessory 34. Teeing area panel 30 is a simulated grass, planar support surface having a bunker tray accessory 36.

A knee brace accessory 38, described in detail hereinbelow, is removably mountable to the main support frame 12. In addition, an upright wall accessory 40 is removably attachable to the main support frame 12 when used in combination with teeing area panel 26, as described in detail hereinbelow.

It will be appreciated that each of the teeing area panels 24, 26, 28 and 30 are identically sized so as to be interchangeable and frictionally fit into the channel 22. As such, different panels may be used to present a golfer with a variety of simulated conditions such as would be found on a golf course, without departing from the spirit of the present invention.

Another feature of the practice platform 10 is portability. With this in mind, an edge of the main support frame 12 of the platform 10 is provided with wheel casters 42. Side edges of the platform 10 are provided with handles 44 to enable the platform 10 to be placed upon its side and rolled, for example, from a storage to a use position.

Figure 4:
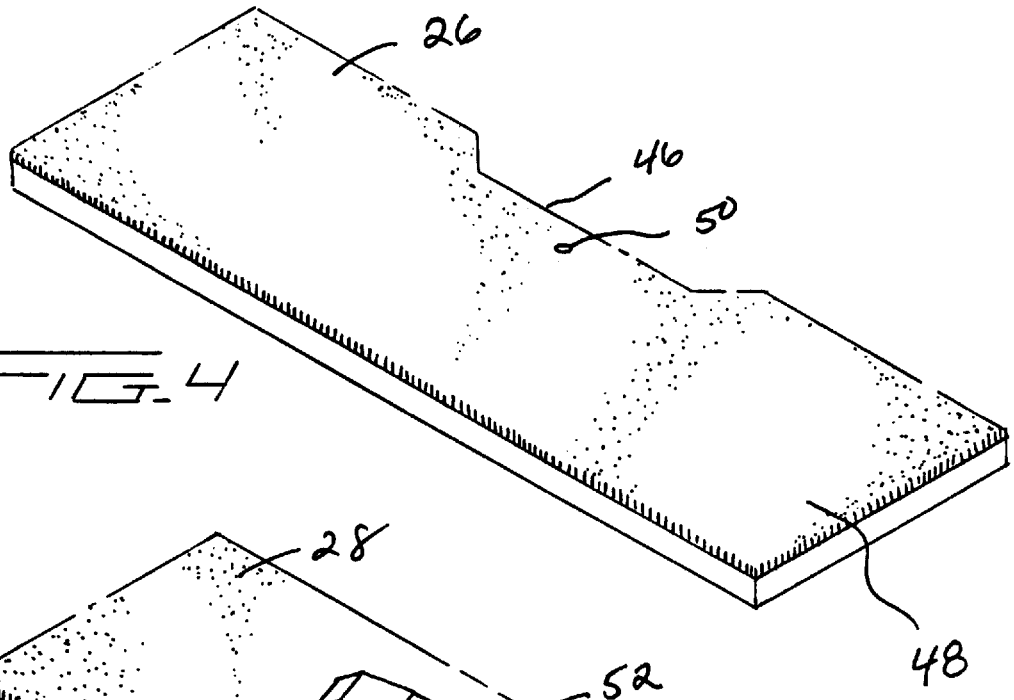
FIG. 4 is a perspective view of an alternate teeing panel used with the present invention.

Referring to FIG. 4, teeing area panel 26 is shown in detail. The teeing panel 26 is generally rectangular in shape and includes a slot 46 along an outer lateral edge 32 for positioning of an upright swing path wall accessory 40 described hereinbelow. Preferably, the teeing area panel 26 is provided with a simulated grass, mat surface 48 and may also include an opening 50 to accommodate a conventional rubber driving range tee (not shown) which would project upwardly through the opening 50 to present a raised tee upon which a ball may be placed. It will be appreciated that the simulated grass may be short to simulate a fairway cut or it may be longer to simulate rough.

Figure 5:
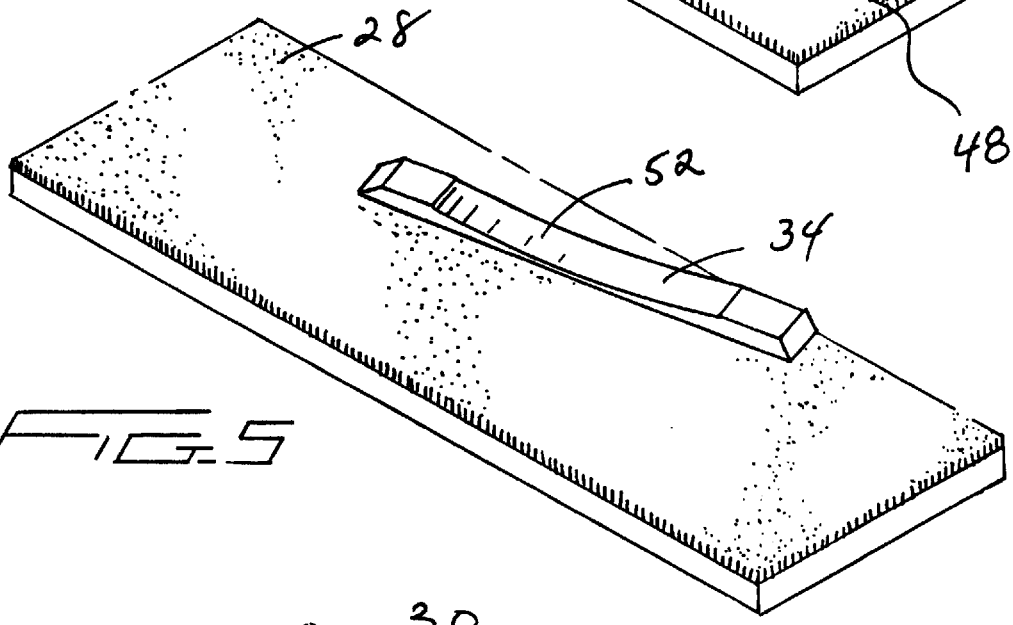
FIG. 5 is a perspective view of still another teeing panel used in accordance with the present invention.

FIG. 5 illustrates in detail the second teeing area panel 28, which is identical in peripheral size to the other panels and fits onto the recessed planar surface 20 on the platform 10 in the same way as described hereinabove. This teeing panel 28 includes an integrally formed bunker board 34 having a slightly concave upper surface 52. The concave upper surface 52 is designed to accommodate natural sand so that it may be used to simulate a sand trap environment for the execution and practice of sand shots.

Figure 6:
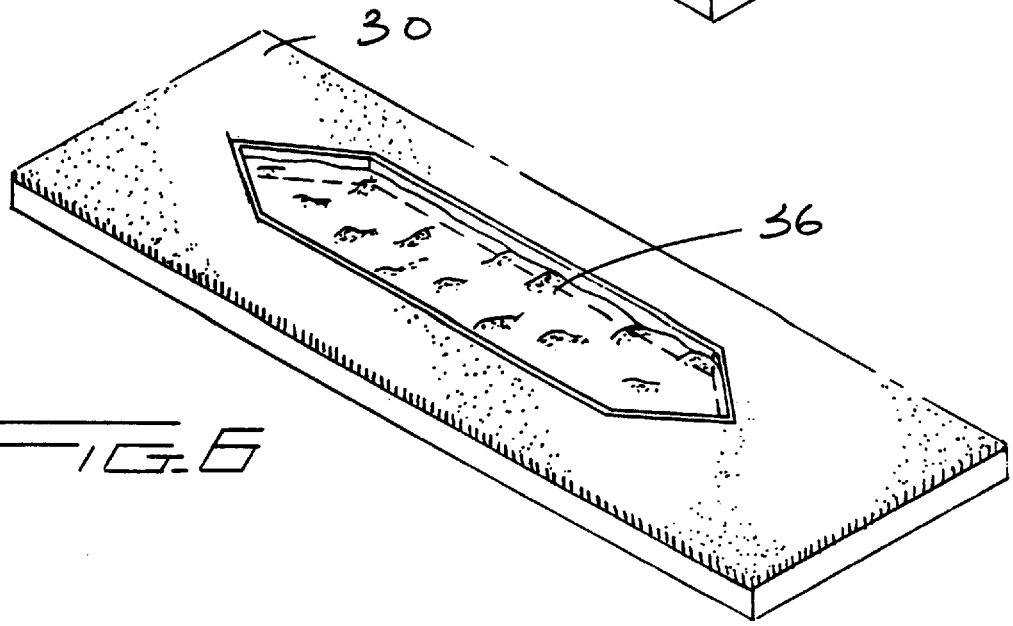
FIG. 6 is a perspective view of yet another teeing panel used in accordance with the present invention.
Figure 7:
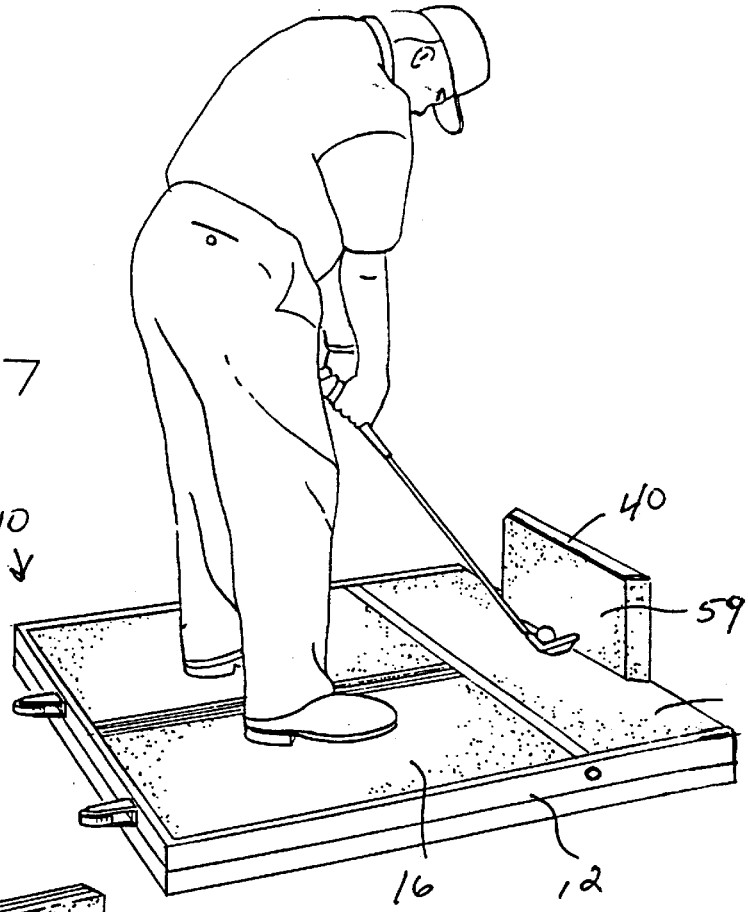

FIG. 6 shows still another interchangeable teeing area panel 30 in detail. The teeing area panel 30 includes a shallow sand tray 36. This panel 30 is also interchangeable with the other panels and fits onto the recessed planar surface 20 of the platform 10. The tray 36 is structured to receive sand so that a golfer may practice sand shots.

Figure 7:
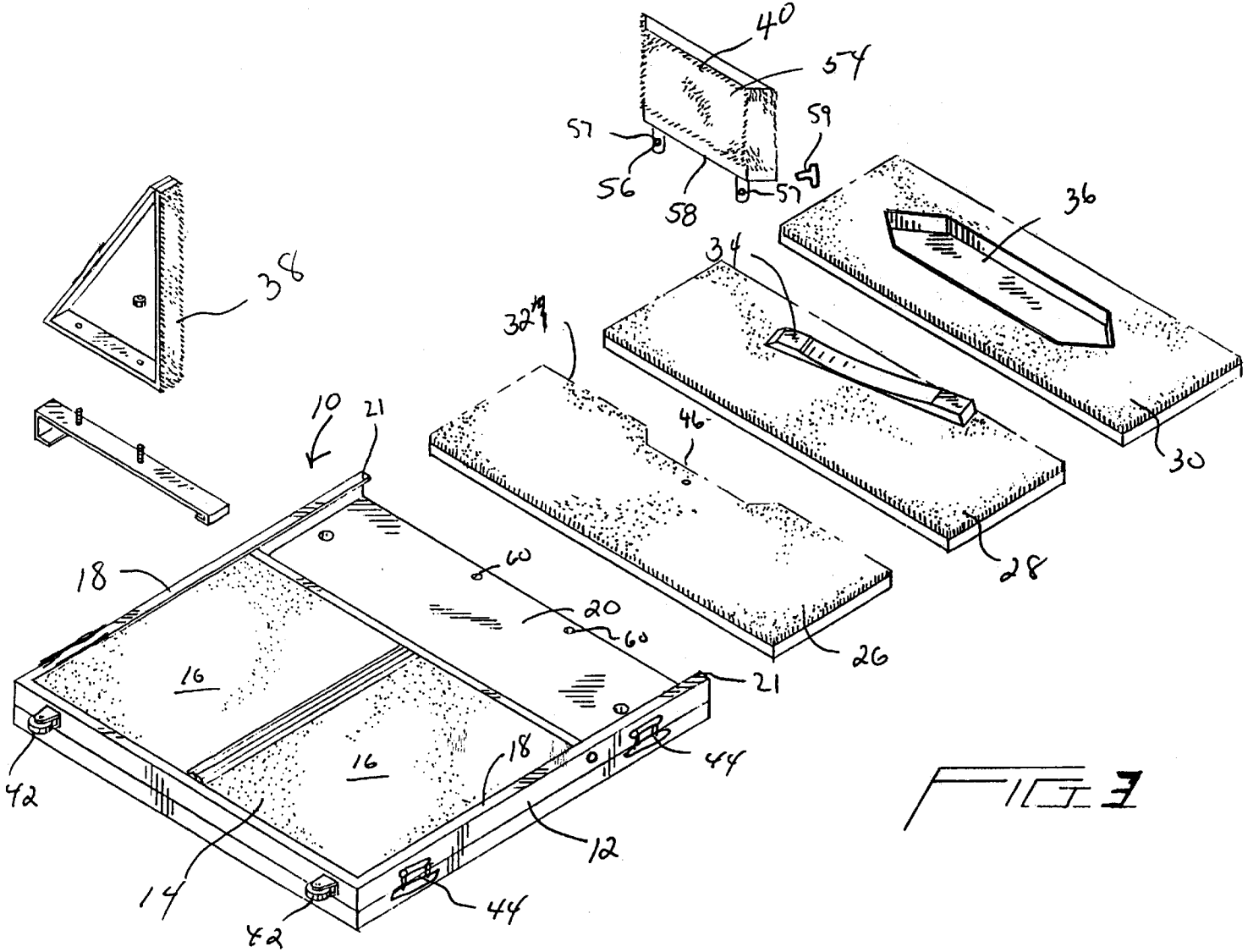
FIG. 7 is a view of the practice platform of FIG. 1 with a first attachment member.

The platform 10 may be used with several training attachments. FIG. 7 illustrates a swing guide attachment in the form of an upright swing path wall 40. The upright wall 40 is shaped and positioned to prevent shanking of golf shots caused by a golf ball being hit by the hosel of the club head.

The upright wall 40 has one side covered in mat fabric 54. The upright wall further includes a pair of support brackets 56 extending downwardly from a lower edge 58 thereof. Each support bracket includes an aperture 57 shaped and dimensioned to receive a locking bolt 59 which may be passed through the aperture 57 and screwed into holes (not shown) formed along the edge of the main support frame 12 to lock the upright wall 40 in position adjacent the hitting area. While a specific attachment structure is disclosed in accordance with a preferred embodiment of the present invention, various attachment structures may be employed without departing from the spirit of the present invention.

When properly positioned, the mat surface 54 of the wall 40 prevents outward movement of a club head as it is being swung. By properly locating a ball to be struck, the possibility of a golfer hitting a shanked shot is totally eliminated.

Figure 9:
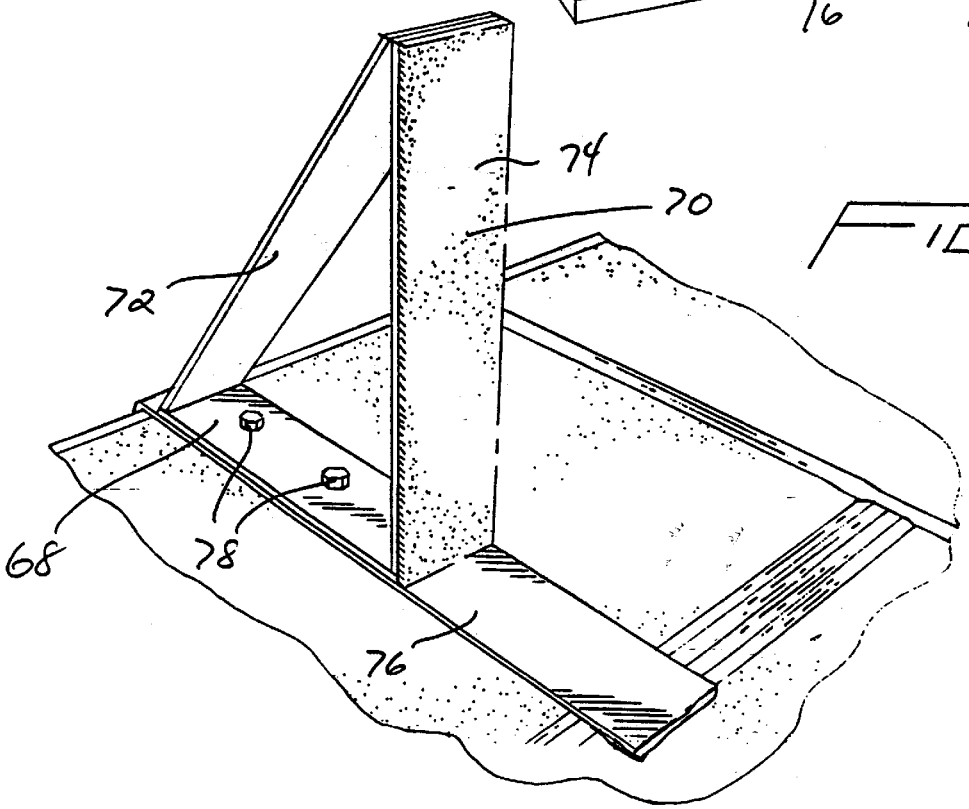
FIG. 9 is a perspective view of a detail of Figure B.

FIGS. 8 and 9 illustrate a training attachment which serves as a knee brace attachment 38 to prevent a golfer's knee from moving laterally forward during the execution of a golf shot. The knee brace attachment 38 is formed by three flat planar members 60 configured into a triangle and extending upwardly against a golfer's leading leg. This prevents the golfer's leg from moving laterally during the execution of a golf swing and promotes weight shift and a leg turn.

The flat planar members 60 of the knee brace attachment 38 is preferably lightweight aluminum. The knee brace attachment 38 has a base 68, an upright leg 70 formed at 90° thereto and an angular support member 72. The members 60 are attached at 90°, 60° and 30°, respectively, although these angles may be increased or decreased, depending upon the overall height of the upright knee brace 38. A soft flexible shock absorbing material 74, such as a piece of carpet or synthetic turf, is attached to the outer side of the upright leg 70 to form a cushion for the golfer's leg.

The knee brace attachment 38 is mounted to a support bracket 76 by connectors 78 and, in turn, is supported to the main support frame 12 by the support bracket 76. While a specific attachment structure is disclosed in accordance with the present invention, various attachment structures may be employed without departing from the spirit of the present invention. For example, it is contemplated in accordance with a preferred embodiment of the present invention that the base 68 be formed with multiple holes to permit ready adjustment of the knee brace's position.

FIG. 10 illustrates another training attachment for use in accordance with the present invention. A swing plane attachment 80 is used to train a golfer the proper inside swing plane position a golf club should traverse through the impact area when striking a golf ball. The swing plane attachment 80 is formed of a solid, rectangular reference board 82 preferably having an upper padded surface.

Figure 10A:
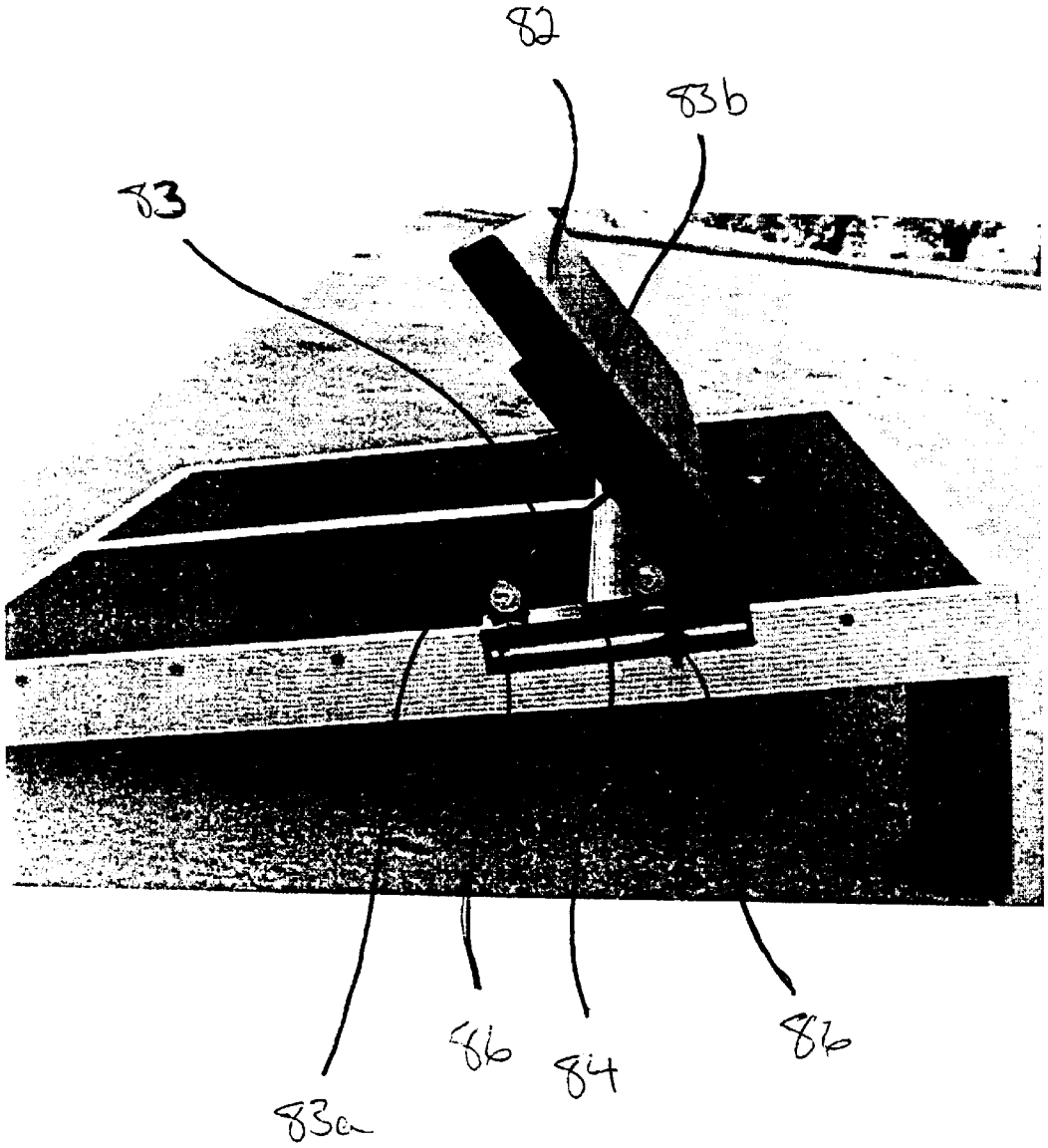
FIG. 10*a* is a side view showing the mounting structure for the attachment member shown in FIG. 10 in detail.

Referred to FIG. 10*a*, the swing plane attachment 80 is pivotally mounted to a bracket 84 shaped and dimensioned for secure attachment to the main support frame 12 of the platform 10. The bracket 84 is secure to the main support frame 12 by a pair of locking bolts 86.

The swing plane attachment 80 rotates to accommodate all sizes and swing shapes of golfers. Using the swing plane attachment 80, a golfer having an excessive inside-out or outside-in swing plane will be given immediate feedback as the club strikes the padded surface of the rectangular reference board 82. With this in mind, the reference board 82 is pivotally supported for angular adjustment. Specifically, a support bar 83 extends between the bracket 84 and the reference board 82 with a first end 83*a* of the support bar 83 being pivotally attached to the bracket 84 and a second end 83*b* of the support bar 83 being releaseably secured to the reference board 82 to allow for attachment of the second end 83*b* at various points along the reference board 82. In this way, the support bar 83 may be adjusted along the reference board 82 to facilitate angular adjustment of the reference board 82. While a specific attachment structure and pivoting structure are disclosed in accordance with the present invention, various attachment and pivoting structures may be employed without departing from the spirit of the present invention.

FIG. 11 shows a swing limiter attachment 90 made of a padded cylindrical stop member 92 which is supported and positioned on an L-shaped, upright rod 94 so as to lie across the swing plane. The upright rod 94 is releaseably secured to the main support frame 12 in much the same manner as the upright wall accessory 40, although a variety of mounting structures may be employed without departing from the spirit of the present invention.

Preferably, the upright rod 94 is telescoping to allow the height of the stop member 92 to be readily adjusted. The padded cylindrical stop member 92 of the swing limiter attachment 90 acts as a stop to engage the shaft of a golf club as the golfer executes the backswing portion of a golf swing. The padded cylindrical stop member 92 may be placed in various backswing positions to provide feedback to the golfer as to the length of a particular backswing.

The teeing panels and attachments described above may be used alone or in combination. For example, A golfer using a simulated grass teeing panel 24 may also use the knee brace 38, the swing slot guide 80, the swing limiter 90 and the anti-shank wall 40 at the same time to perfect a golf swing.

Referring to FIGS. 12 to 15, the platform 10 is designed to be positioned at a variety of support angles by using a pair of support blocks 99 which may be placed on adjacent, inner corners of the support platform to raise a particular edge depending upon the ground angle to be simulated. By selecting the location of the support blocks 99, it will be appreciated that the platform 10 may be sloped upwardly, downwardly and to either side depending upon the location of the blocks 99. This enables a golfer to hit golf shots simulating uphill lies, downhill lies, lies where the ball is below the golfer's feet, and lies where the ball is above the golfer's feet. The blocks 99 may be of a variety of sizes to simulate a smaller or greater slope of the simulated ground surface.

Figure 12:
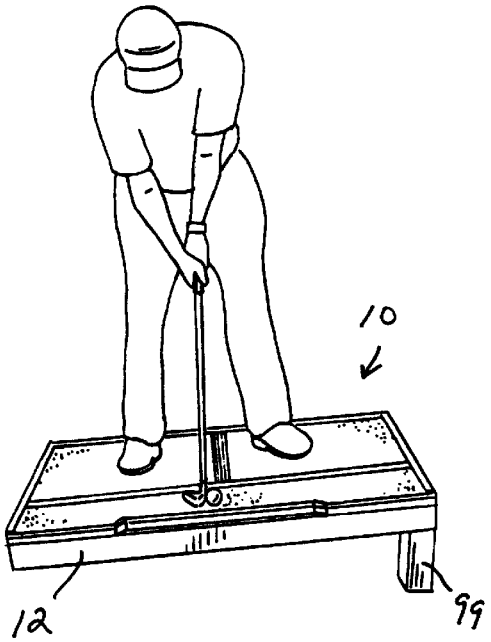
FIG. 12 is a perspective view of the practice platform of FIG. 1 disposed at a first simulated lie position.

FIG. 12 illustrates a practice platform 10 wherein the elevating blocks 99 are positioned on a forward edge of the practice platform 10, thereby simulating an uphill lie condition for the golfer.

Figure 13:
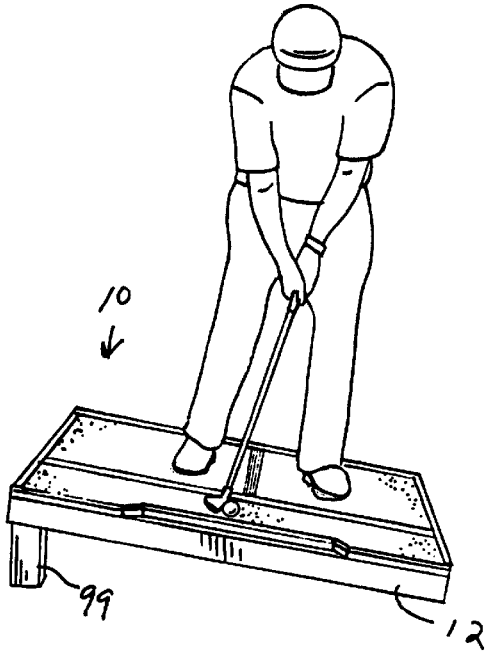
FIG. 13 is a perspective view of the practice platform of FIG. 1 disposed at a second simulated lie position.

FIG. 13 illustrates a practice platform 10 wherein the elevating blocks 99 are located along a rearward edge of the platform 10, thereby simulating a downhill lie condition for the golfer.

Figure 14:
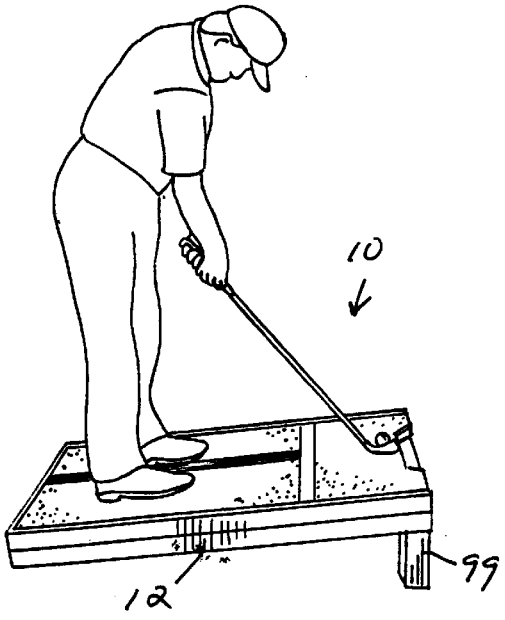
FIG. 14 is a perspective view of the practice platform of FIG. 1 disposed at a third simulated lie position.

FIG. 14 illustrates a golf practice platform 10 of the present invention using a pair of support blocks 99 which elevate a side of the platform 10 above ground surface to simulate a lie condition where a golf ball is above the feet of a player.

Figure 15:
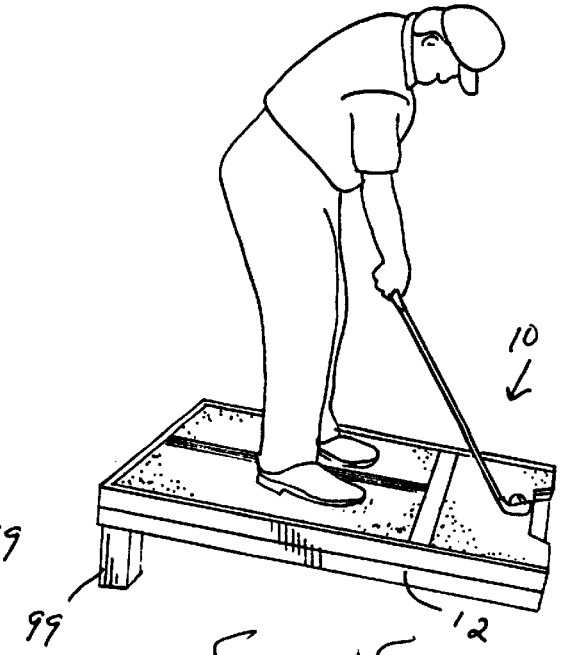
FIG. 15 is a perspective view of the practice platform of FIG. 1 disposed at a fourth simulated lie position.

FIG. 15 illustrates a practice platform wherein the elevating blocks 99 are located on the opposite side of the platform 10, thereby simulating a position where a golf ball is below the feet of the golfer.

Figure 16:
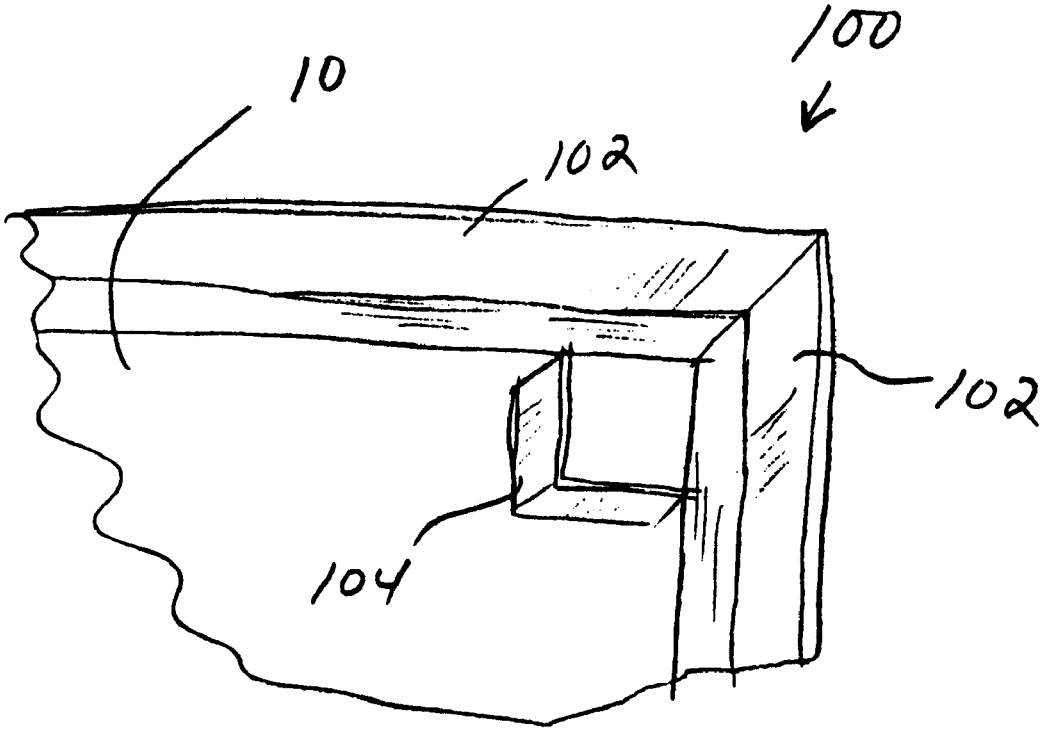
FIG. 16 is a partial view of the underside of the practice platform of the present invention.

FIG. 16 illustrates a corner 100 of the underside of the platform 10. The edges 102 of the main support frame 12 cooperate with a corner bracket 104 to locate a supporting block (not shown) in position. Each corner 100 has the same structure permitting any two corners to be used with supporting blocks to simulate the lie conditions described with reference to FIGS. 12 to 15 hereinabove.

While various preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A golf practice apparatus for aiding a golfer to practice a variety of golf swing movements and golf shots comprising:

a main support frame including a planar support surface for supporting a golfer in a standing position and allowing him to execute a golf swing;

a recessed secondary support surface integrally formed along one side of said main support frame, the recessed secondary support surface including a secondary planar surface;

at least one interchangeable teeing panel simulating a variety of conditions found on a golf course;

a swing plane guide attachment pivotally connected to said main support frame, the swing plane guide being centrally positioned on the main support frame to train a golfer as to a proper inside swing plane position a golf club should traverse through the impact area when striking a golf ball; and means on said recessed secondary support surface for connection of one of said teeing panel on top of said secondary planar surface of said secondary support surface, wherein said means for connection includes a pair of longitudinal channels extending above and along edges of said recessed secondary support surface; said channels being sized to receive and support said interchangeable teeing panel.

2. The golf practice apparatus of claim 1 wherein said longitudinal channels are integrally formed with said main support frame.

3. The golf practice apparatus of claim 1 wherein said teeing panel includes a simulated grass surface.

4. The golf practice apparatus of claim 1 wherein said teeing panel includes a board having a concave upper surface for practicing sand shots.

5. The golf practice apparatus of claim 1 wherein said teeing panel includes a sand filled tray of a size appropriate for practicing sand shots.

6. The golf practice apparatus of claim 1, further including at least one training attachment connected to said main support platform and means for maintaining said training attachment connected thereto.

7. The golf practice apparatus of claim 6 wherein said training attachment is an adjustable swing limiter attachment; said adjustable swing limiter attachment having a telescoping mounting rod projecting upwardly from said secondary support surface and a barrier extending into the golfer's swing plane.

8. The golf practice apparatus of claim 7 wherein said barrier is further defined as a padded cylindrical stop member mounted on said rod.

9. The golf practice apparatus of claim 6 wherein said training attachment is a knee brace attachment mounted on said planar support surface to limit lateral movement of a golfer's knee and leg while executing a golf swing.

10. The golf practice apparatus of claim 9 wherein said knee brace attachment is further defined by an upright, triangular shaped brace member and a bracket for mounting said brace member on said planar support surface.

11. The golf practice apparatus of claim 6 further including an adjustable swing limiter attachment; said adjustable swing limiter attachment having a telescoping mounting rod projecting upwardly from said secondary support surface and a barrier extending into the golfer's swing plane.

12. The golf practice apparatus of claim 6 further including a knee brace attachment mounted on said planar support surface to limit lateral movement of a golfer's knee and leg while executing a golf swing.

13. The golf practice apparatus of claim 1 further including at least two support blocks structured to be placed on the underside of said main support frame to raise one edge of said apparatus to simulate a non-level ground surface.

14. A golf practice apparatus for aiding a golfer to practice a variety of golf swing movements and golf shots comprising:

a main support frame including a planar support surface for supporting a golfer in a standing position and allowing him to execute a golf swing;

a recessed secondary support surface integrally formed along one side of said main support frame, the recessed secondary support surface including a secondary planar surface;

at least one interchangeable teeing panel simulating a variety of conditions found on a golf course, said teeing panel including a slot along an outer lateral edge thereof, wherein the slot is shaped and dimensioned for receiving an upright wall and the upright wall includes means for selective attachment to the recessed secondary support surface; and means on said recessed secondary support surface for connection of one of said teeing panel on top of said secondary planar surface of said secondary support, wherein said means for connection includes a pair of longitudinal channels extending above and along edges of said recessed secondary support surface; said channels being sized to receive and support said interchangeable teeing panel.

15. The golf practice apparatus of claim 14 wherein said longitudinal channels are integrally formed with said main support frame.

16. The golf practice apparatus of claim 14 wherein said teeing panel includes a simulated grass surface.

17. The golf practice apparatus of claim 14 wherein said teeing panel includes a board having a concave upper surface for practicing sand shots.

18. The golf practice apparatus of claim 14 wherein said teeing panel includes a sand filled tray of a size appropriate for practicing sand shots.

19. The golf practice apparatus of claim 14 wherein said upright wall further includes a mat surface.

20. The golf practice apparatus of claim 14 further including at least two support blocks structured to be placed on the underside of said main support frame to raise one edge of said apparatus to simulate a non-level ground surface.

* * * * *